US006494159B2

(12) United States Patent
Sirmalis et al.

(10) Patent No.: US 6,494,159 B2
(45) Date of Patent: Dec. 17, 2002

(54) SUBMARINE LAUNCHED UNMANNED COMBAT VEHICLE REPLENISHMENT

(75) Inventors: John E. Sirmalis, Barrington, RI (US); Pamela J. Lisiewicz, Tiverton, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/853,934

(22) Filed: May 11, 2001

(65) Prior Publication Data

US 2002/0166492 A1 Nov. 14, 2002

(51) Int. Cl.[7] ..... B63G 8/00

(52) U.S. Cl. ..... 114/312; 114/20.1; 114/238; 367/131

(58) Field of Search ..... 114/312, 316, 114/382, 258, 238, 318, 319, 322, 20.1; 340/850, 851, 852; 367/133, 134, 131

(56) References Cited

U.S. PATENT DOCUMENTS 5,214,618 A * 5/1993 Bugiel ..... 367/131
5,291,194 A * 3/1994 Ames ..... 340/850
5,377,165 A * 12/1994 LaPointe et al. ..... 367/134
5,675,117 A * 10/1997 Hillenbrand ..... 114/318
5,690,041 A * 11/1997 Hillenbrand et al. ..... 114/21.2
5,748,102 A * 5/1998 Barron ..... 114/312
5,964,175 A * 10/1999 Sirmalis et al. ..... 114/238
6,118,066 A * 9/2000 Sirmalis et al. ..... 114/20.1
6,269,763 B1 * 8/2001 Woodland ..... 114/382

* cited by examiner

*Primary Examiner*—S. Joseph Morano
*Assistant Examiner*—Lars A. Olson
(74) *Attorney, Agent, or Firm*—Michael J. McGowan; James M. Kasischke; Michael F. Oglo

(57) ABSTRACT

A system and method is provided to replenish a submarine's tactical capabilities, e.g., weapons, sensors and communications, while the submarine remains within a hostile environment. One or more Underwater Combat Vehicles (UCV's) are pre-positioned at strategic locations or are launched from a surface and/or airborne platform. The UCV's include full tactical capabilities, which can attach to and be integrated with a submarine's capabilities. To initiate replenishment, a submarine broadcasts a signal, or dispatches one of the UCV's under its direct control, to make contact with one of the pre-positioned UCV's or with a central command platform. The pre-positioned UCV's are programmed to search for and locate the submarine. This can either be accomplished using signals broadcast from the submarine, or using UCV internal navigation systems and a last known position for the submarine. Once located, communication between the submarine and UCV allows docking of the UCV onto the submarine.

19 Claims, 2 Drawing Sheets

SUBMARINE LAUNCHED UNMANNED COMBAT VEHICLE REPLENISHMENT

STATEMENT OF GOVERNMENT INTEREST

The invention described herein may be manufactured and used by or for the Government of the United States of America for governmental purposes without the payment of any royalties thereon or therefore.

CROSS-REFERENCE TO RELATED APPLICATIONS

There are no related patent applications.

BACKGROUND OF THE INVENTION (1) Field of the Invention

The present invention relates generally to unmanned underwater vehicles, and more particularly to a method using an unmanned underwater vehicle to provide in-situ replenishment of a submarine's tactical capabilities.

(2) Description of the Prior Art

Recent testing using scale models have demonstrated the potential of programmable, or mission reconfigurable, unmanned underwater vehicles operating in concert with a submarine. Such underwater unmanned vehicles, referred to as Unmanned Combat Vehicles (UCV's) are hydrodynamically and stealth shaped, and provide an extended sphere of influence for the submarine. Current battle scenarios call for submarine operation in the littoral area. With the shallow depth and generally heavy surface ship traffic in littoral areas, the submarine becomes extremely vulnerable to hostile attack. The UCV can provide detailed intelligence, surveillance and environmental data to the submarine without the need for the submarine to enter the littoral area. The initial concept for UCV use was recited in U.S. Pat. No. 6,118,066 entitled AUTONOMOUS UNDERSEA PLATFORM, by the current inventors and incorporated herein by reference.

Advanced weapons systems on contemplated UCV's make the platform an excellent standoff weapon system. Artificial intelligence and neural network processing capabilities allow the platform to operate autonomously when provided with general mission requirements and boundaries. In terms of submarine use, a number of UCV's may be attached to the submarine, each independently launched on a mission and returned to the sub at the completion of the mission. However, in a hostile engagement scenario, the weapons systems aboard the platforms may be depleted. No method or system exists to replenish or reload fully equipped UCV's at the submarine. Such a method and system for replenishing the weapons systems during such an engagement would greatly enhance survivability of the submarine and its crew.

SUMMARY OF THE INVENTION

Accordingly, it is an object of the present invention to provide a method and system for replenishing a submarine's tactical capabilities in situ.

Another object of the present invention is to provide a method and system to replenish a submarine's depleted Underwater Combat Vehicles.

Other objects and advantages of the present invention will become more obvious hereinafter in the specification and drawings.

In accordance with the present invention, the method consists of providing one or more UCV's in addition to those attached, or dedicated, to one particular submarine. These additional UCV's are either pre-positioned, surface launched, or air launched to rendezvous with a submarine in need of additional tactical capabilities. In the pre-positioned mode, the additional UCV's are placed at strategic locations in the general vicinity of a potential conflict. As an example, UCV's may be located at U.S. overseas military bases or friendly ports about the Persian Gulf. If a conflict is imminent, the UCV's may also be positioned in well-concealed underwater locations near the conflict area. In the pre-positioned mode, the UCV's are in a standby status awaiting instructions or programming. However, the sensor suites aboard the UCV's may remain active to provide a sensor network near or within the conflict area. This network may be used by surface, airborne, or other platforms to provide increased surveillance in the area.

Surface or air launches of the UCV's may be accomplished during a conflict, or at other times when pre-positioning the UCV's near or within the conflict area would present too great a risk. A launch from a surface ship may be accomplished from a position well removed from the conflict area. The launch can easily be accomplished in a covert manner and the UCV can travel virtually undetected to the conflict site. A launch from an aircraft would not be as covert, but may be necessary where time for replenishment is critical.

The additional UCV's are programmed to search for and locate the submarine to be resupplied. This can either be accomplished using signals broadcast from the submarine, communications between the submarine and the UCV's, or using UCV internal navigation systems and a last known position for the submarine. Signals and communications may include electromagnetic or acoustic singles and communications. Once located, communication between the submarine and UCV allows docking of the UCV onto the submarine. To initiate resupply, a submarine may broadcast a signal either to one of the UCV's on standby, or to a central command. In a battle space environment, such external communication may not be possible. Thus, instead of returning to the submarine, depleted sub-launched UCV's may be programmed to proceed to a site where they can rendezvous or make contact with a standby UCV, central command, or other platform. Once contact is made, the replenishment UCV can be launched. In a still further scenario, a depleted UCV returning to the submarine may be reprogrammed at the submarine to search for and locate a specific UCV having the ordnance (torpedoes, missiles), countermeasures, sensors, or communications hardware most needed by the submarine. The submarine can also dispatch the UCV to proceed to the contact site as noted above. It can be seen that the method envisioned in the disclosure requires a system of UCV's traveling in and out of the battle space as required, rather than UCV's confined to operation in concert with a single submarine.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENT

Figure 1:
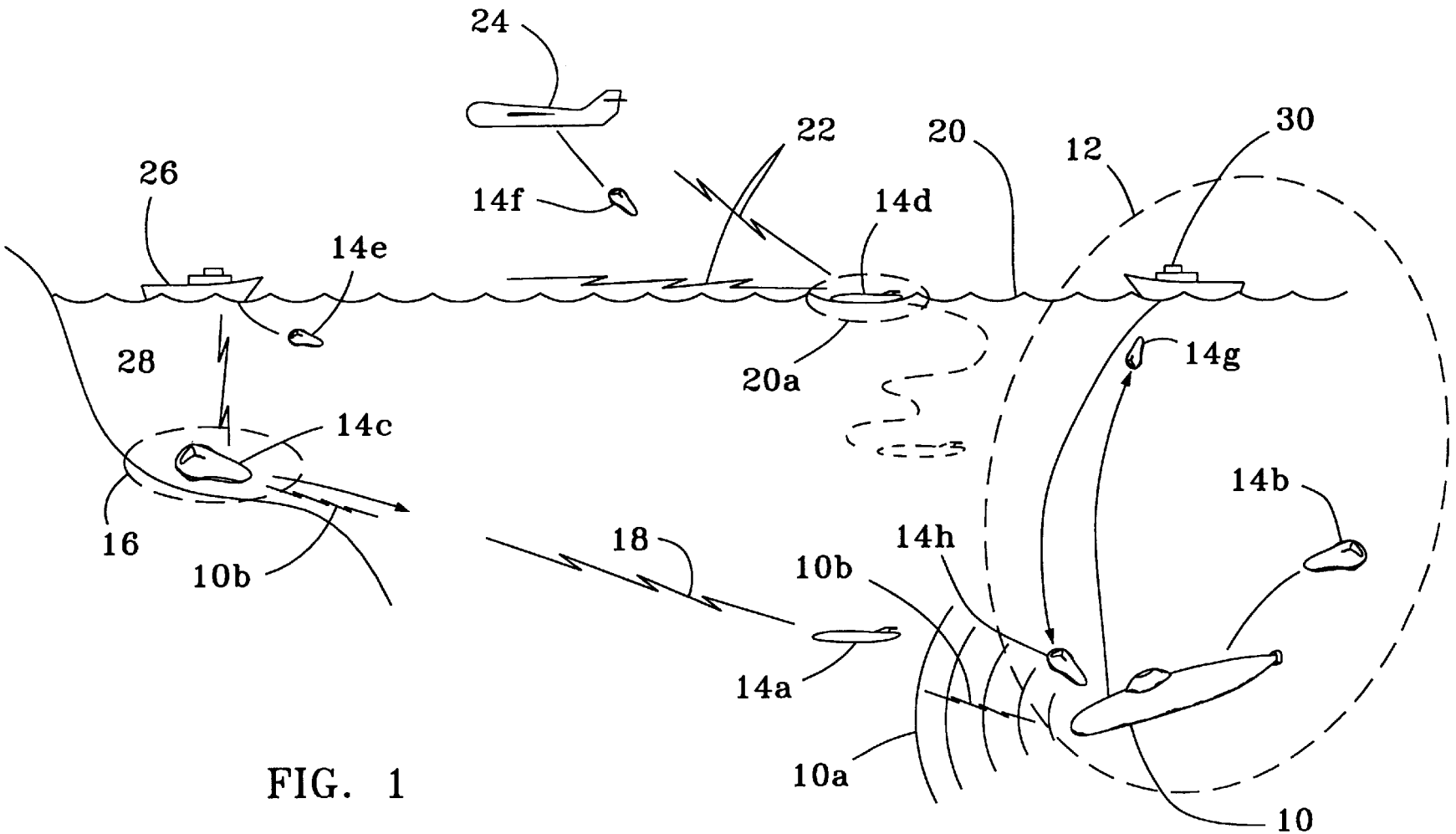
FIG. 1 is a schematic representation of the vicinity near a conflict area illustrating the use of the method of the present invention.

Referring now to FIG. 1, there is shown a schematic representation of the system of the present invention. Submarine 10 is depicted within a battle space environment 12. Submarine 10 has at least one Unmanned Combat Vehicle (UCV) 14 that it can launch as a standoff weapon system. Each UCV 14 has a suite of sensors, communications equipment and weapons that serve as adjunct to submarine 10's own tactical systems. In FIG. 1, UCV 14*a* and UCV 14*b* are depicted as having been launched from submarine 10. During a combat or reconnaissance mission, a UCV 14 may be required to expend its weapons or sensors in the performance of its mission. In the prior art, an expended UCV 14 would return to and dock with submarine 10. When replenishment of its an tactical capabilities was required, submarine 10 would leave environment 12 and proceed to a facility having the logistics necessary to replenish submarine 10.

In the system depicted in FIG. 1, UCV 14*a* has depleted its weapons and sensor stores and requires replenishment. UCV 14*c* has been pre-positioned at a location 16 somewhat remote from battle environment 12. Location 16 is chosen for strategic reasons, such as ease of concealment and ease of establishing communications. UCV 14*c* may have been brought to location 16 by another submarine, by a surface ship or other platform. In a preferred embodiment, UCV 14*c* has been programmed to make its way to location 16 once launched from a platform. Preferably, UCV 14*c* is one of many such UCV 14's pre-positioned about environment 12, each having a full suite of tactical capabilities, e.g., weapons, sensors and communications equipment. UCV 14*a* is programmed to make contact with pre-positioned UCV 14*c*, illustrated by lines 18, once UCV 14*a* is depleted. Alternatively, a depleted UCV 14*d* can also be programmed to rise to the surface 20 or proceed to a specific rendezvous point 20*a*, so as to make contact, illustrated by lines 22, with a nearby platform, such as airborne platform 24 or surface ship platform 26. Platform 24 or 26 can then contact UCV 14*c*, as shown by lines 28. In a further alternate scenario, platform 24 or 26 may launch a replenishment UCV 14*e*, or 14*f*, respectively.

Each replenishment UCV 14*c*, 14*e*, or 14*f*, is programmed such that, once contacted or launched, UCV 14*c*, 14*e*, or 14*f*, searches for and locates submarine 10 that originally launched the depleted UCV 14's. Depending on the specific scenario, UCV 14*c* may navigate to submarine 10 by using signals 10*a* broadcast from submarine 10, by two-way communication 10*b* between the submarine 10 and UCV 14*c*, or by using inertial navigation systems onboard UCV 14*c* and a last known position of the submarine 10. It is noted that signals 10*a* and communication 10*b* may be electromagnetic or acoustic in nature. In an alternative scenario, depleted UCV 14*b* returns to submarine 10 and is reprogrammed at submarine 10 to search for, or otherwise make contact with, replenishment UCV 14*c*, as previously described. Further, submarine 10 may reprogram UCV 14*b* to search for and locate a specific replenishment UCV 14 having the mix of weapons, sensors, countermeasures, etc., most needed by submarine 10.

Figure 2:
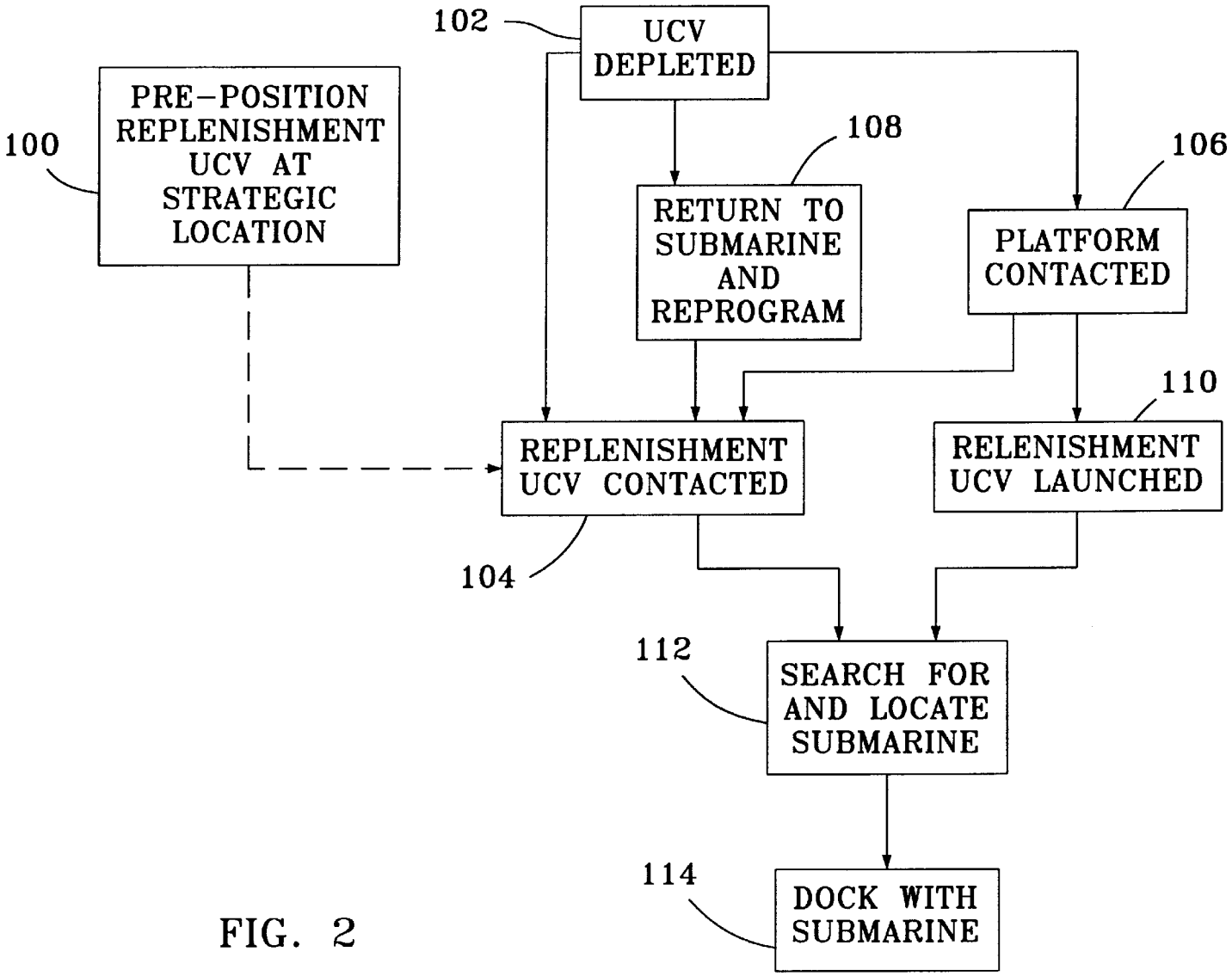
FIG. 2 is a block diagram for the implementation of the method of the present invention.

Referring now to FIG. 2, there is shown a block diagram for implementing the system of FIG. 1. For those scenarios where appropriate locations can be found, at least one replenishment UCV 14*c* is pre-positioned at strategic location 16 (100). After UCV 14*a*, 14*b*, or 14*d* is depleted (102), their internal programming has them contact replenishment UCV 14*c* directly (104), proceed to the surface 20 or a rendezvous site 20*a* to contact platform 24 or 26 (106), or return to submarine 10 to be reprogrammed (108), respectively. If platform 24 or 26 is contacted (106), platform 24, 26 may then contact the replenishment UCV 14*c* (104) or launch a replenishment UCV 14*e*, 14*f* of its own (110). Depleted UCV 14*b* returning to submarine 10 may be programmed (108) to either contact UCV 14*c* (104) or contact one of the platforms 24, 26 (106). Once the replenishment UCV is contacted (14*c*) or launched (14*e*, 14*f*), it searches for and locates submarine 10 (112). Once submarine 10 is located (112), UCV 14*c*, 14*e*, 14*f* docks with submarine 10 to replenish its tactical capabilities (114).

The invention thus described provides a system and method to replenish a submarine's tactical capabilities without requiring the submarine to leave the battle environment. The system and method is utilized in conjunction with a submarine equipped with UCV's having full suites of tactical equipment and serving as adjuncts to the submarine's tactical capabilities. When one or more of the tactical equipment suites of a UCV launched from the submarine has been depleted, a replenishment UCV is contacted. The UCV with the depleted suite may either contact a pre-positioned replenishment UCV directly, or may be programmed to rise to the surface at a rendezvous site and contact a nearby control platform, such as a surface ship. The control platform may contact the pre-positioned UCV or may launch a replenishment UCV. The replenishment UCV is programmed to search for, locate and dock with the submarine and thus provide the submarine with its full complement of tactical capabilities.

Although the present invention has been described relative to a specific embodiment thereof, it is not so limited. There are a large number of scenarios in which such a system of UCV 14's can be utilized. As an example, submarine 10 and surface ship 30 may be operating in the same environment 12, or in nearby environments. In order to optimize their payloads for their theatre of operation, submarine 10 and ship 30 may swap UCV 14*g* and UCV 14*h*. Further, once UCV 14*c* is pre-positioned, UCV 14*c* may be placed in a standby mode, awaiting contact so as to begin its search for submarine 10. Additionally, while in the standby mode, UCV 14*c* may have its sensor suite active to form a sensor net with other UCV 14*c* 's pre-positioned about environment 12.

Thus, it will be understood that many additional changes in the details, steps and scenarios, which have been herein described and illustrated in order to explain the nature of the invention, may be made by those skilled in the art within the principle and scope of the invention as expressed in the appended claims.

What is claimed is:

1. A system for replenishing tactical capabilities of a submarine while remaining within a battle environment, the system comprising:

a first unmanned combat vehicle launched from the submarine and having one or more depleted suites of tactical equipment, the unmanned combat vehicle serving as an adjunct to the tactical capabilities of the submarine when attached to the submarine with no depleted suites of tactical equipment; and at least one second unmanned combat vehicle having full suites of tactical equipment and programmed to search for, locate and dock with the submarine when informed that the first unmanned combat vehicle has one or more depleted suites of tactical equipment, the at least one second unmanned combat vehicle serving as the adjunct to the tactical capabilities of the submarine in lieu of the first unmanned combat vehicle.

2. The system of claim 1, wherein each of the at least one second unmanned combat vehicles is pre-positioned at a strategic location remote from the battle environment.

3. The system of claim 2, wherein the first unmanned combat vehicle is programmed to make direct contact with the at least one second unmanned combat vehicle to inform the at least one second unmanned combat vehicle.

4. The system of claim 2, wherein at least two second unmanned combat vehicles are pre-positioned, the at least two second unmanned combat vehicles forming a sensor net about the battle environment.

5. The system of claim 2, wherein:

the first unmanned combat vehicle is programmed to return to the submarine; and the submarine programs the first unmanned combat vehicle to inform the at least one second unmanned combat vehicle.

6. The system of claim 5, wherein the first unmanned combat vehicle is programmed to make direct contact with the at least one second unmanned combat vehicle to inform the at least one second unmanned combat vehicle.

7. The system of claim 5, wherein:

the first unmanned combat vehicle is programmed to proceed to a previously determined rendezvous site;

the first unmanned combat vehicle makes contact with a control platform nearby the rendezvous site; and the control platform makes contact with the at least one second unmanned combat vehicle to inform the at least one second unmanned combat vehicle.

8. The system of claim 1, wherein the first unmanned combat vehicle is programmed to make direct contact with the at least one second unmanned combat vehicle to inform the at least one second unmanned combat vehicle.

9. The system of claim 1, further comprising:

a control platform capable of communicating with the at least one second unmanned combat vehicle, wherein:

the first unmanned combat vehicle is programmed to proceed to a previously determined rendezvous site;

the first unmanned combat vehicle makes contact with said control platform nearby the rendezvous site; and the control platform makes contact with the at least one second unmanned combat vehicle to inform the at least one second unmanned combat vehicle.

10. The system of claim 9 wherein the at least one second unmanned combat vehicle informed is pre-positioned in a strategic location remote from the battle environment.

11. The system of claim 9, wherein the at least one second unmanned combat vehicle informed is launched from the control platform.

12. The system of claim 1, wherein:

the first unmanned combat vehicle is programmed to return to the submarine; and the submarine programs the first unmanned combat vehicle to inform the at least one second unmanned combat vehicle.

13. The system of claim 1, wherein the submarine signals the at least one second unmanned combat vehicle to assist the at least one second unmanned combat vehicle in locating the submarine.

14. The system of claim 1, wherein the at least one second unmanned combat vehicle has an inertial guidance system and a last known location of the submarine, the at least one second unmanned combat vehicle being programmed to travel to the last known location of the submarine and search for the submarine.

15. A method of replenishing tactical capabilities of a submarine within a battle environment, comprising:

informing a replenishment unmanned combat vehicle having full suites of tactical capabilities that an adjunct unmanned combat vehicle associated with a submarine has depleted one or more tactical suites; and launching the replenishment unmanned combat vehicle to search for, locate and dock with the submarine in accordance with previously programmed instructions.

16. The method of claim 15, further comprising pre-positioning the replenishment unmanned combat vehicle at a strategic location near the battle environment.

17. The method of claim 15, wherein informing the replenishment unmanned combat vehicle further comprises programming the adjunct unmanned combat vehicle to make direct contact with the replenishment unmanned combat vehicle.

18. The method of claim 15, wherein informing the replenishment unmanned combat vehicle further comprises:

programming the adjunct unmanned combat vehicle to proceed to a predetermined rendezvous location;

programming the adjunct unmanned combat vehicle to contact a control platform near the rendezvous location; and contacting the replenishment unmanned combat vehicle from the platform.

19. The method of claim 15, wherein informing the replenishment unmanned combat vehicle further comprises:

programming the adjunct unmanned combat vehicle to return to the submarine; and programming the adjunct unmanned combat vehicle from the submarine to contact the replenishment unmanned combat vehicle.

* * * * *